United States Patent [19]

Ueno

[11] Patent Number: 4,757,284

[45] Date of Patent: Jul. 12, 1988

[54] DIELECTRIC FILTER OF INTERDIGITAL LINE TYPE

[75] Inventor: Moriaki Ueno, Soma, Japan

[73] Assignee: Alps Electric Co., Ltd., Japan

[21] Appl. No.: 848,711

[22] Filed: Apr. 4, 1986

[30] Foreign Application Priority Data

Apr. 4, 1985 [JP] Japan ..... 60-50772[U]

[51] Int. Cl.[4] ..... H01P 1/20

[52] U.S. Cl. ..... 333/203; 333/206

[58] Field of Search ..... 333/202, 203, 206, 207, 333/219, 222–226, 233

[56] References Cited

U.S. PATENT DOCUMENTS

| | | | |
|---|---|---|---|
| 3,818,389 | 6/1974 | Fisher | 333/203 |
| 4,053,855 | 10/1977 | Kivi et al. | 333/73 W |
| 4,254,390 | 3/1981 | Saito et al. | 333/222 X |
| 4,255,729 | 3/1981 | Fukasawa et al. | 333/202 |
| 4,283,697 | 8/1981 | Masuda et al. | 333/202 |
| 4,431,977 | 2/1984 | Sokola et al. | 333/222 X |
| 4,506,241 | 3/1985 | Makimoto et al. | 333/222 |
| 4,523,162 | 6/1985 | Johnson | 333/202 |
| 4,631,506 | 12/1986 | Makimoto et al. | 333/224 |

FOREIGN PATENT DOCUMENTS

| | | | |
|---|---|---|---|
| 2714181 | 10/1978 | Fed. Rep. of Germany | 333/203 |
| 0019405 | 1/1984 | Japan | 333/206 |
| 0114902 | 7/1984 | Japan | 333/202 |
| 0001901 | 1/1985 | Japan | 333/206 |

*Primary Examiner*—Eugene R. Laroche
*Assistant Examiner*—Seung Ham
*Attorney, Agent, or Firm*—Guy W. Shoup; Leighton K. Chong

[57] ABSTRACT

An interdigital line type dielectric filter acting as a bandpass filter at radio frequencies has a dielectric body on which a grounding electrode is formed. Two parallel exciter lines extend through the block. Several resonant lines are juxtaposed to one another between the exciter lines. One short-circuited end of each resonant line is connected to the grounding electrode, while the other open end is not connected to it. The short-circuited end and the open end of any one of the resonant lines are disposed on opposite sides of those of its neighboring one resonant line. Those portions of the block which are in the vicinities of the open ends of the resonant lines are cut out so that the open ends are exposed.

4 Claims, 4 Drawing Sheets

DIELECTRIC FILTER OF INTERDIGITAL LINE TYPE

FIELD OF THE INVENTION

The present invention relates to an interdigital line type dielectric filter used at radio frequencies.

BACKGROUND OF THE INVENTION

Bandpass filters heretofore used in the radio-frequency band ranging from the VHF band nearly to microwaves are comb line filters and interdigital line type filters, in which resonant lines are formed within an envelope made from a conductor such as a metal. The inside of the envelope is permeated with air or kept in vacuum. This air space or vacuum constitutes a medium through which electromagnetic waves propagate between the resonant lines.

A conventional three-stage interdigital type filter of this kind is shown in FIGS. 6 and 7. This filter has an envelope 1 and its cover 2, both of which are made of a conductive metal. Two metal rods acting as exciter lines 3 and 4 are disposed on opposite sides within the envelope 1. Three metal rods serving as resonant lines 5, 6, 7 are substantially regularly spaced from each other between the exciter lines 3 and 4. The envelope 1 is provided with holes 1*a* and 1*b* on its one side, and the exciter lines 3 and 4 protrude outwardly through the holes 1*a* and 1*b*, respectively. These protruding portions form an input terminal 3*a* and an output terminal 4*a*. The exciter lines 3 and 4 are held to the inner wall of the envelope 1 at their rear ends 3*b* and 4*b* that are short-circuited surfaces. The three resonant lines 5, 6, 7 have open surfaces 5*a*, 6*a*, 7*a* and short-circuited surfaces 5*b*, 6*b*, 7*b*, respectively, at their opposite ends Any neighboring two of the open surfaces 5*a*–7*a* are on opposite sides. Also, any neighboring two of the short-circuited surfaces 5*b*–7*b* are on opposite sides. The resonant lines 5–7 are held to the inner wall of the envelope 1 at their short-circuited surfaces 5*b*–7*b*. Although the inside of the envelope 1 may be kept in vacuum, it is permeated with air in the illustrated example. Accordingly, space is left between the open surfaces 5*a*–7*a* of the resonant lines 5–7 and the opposite inner wall of the envelope 1. The resonant lines 3 and 4 excite the resonant lines 5–7 and perform transformation of impedance. Since the resonant lines 5, 6, 7 exhibit bandpass characteristics, the interdigital line type filter functions as a bandpass filter.

Another conventional filter is shown in FIGS. 8 and 9. This filter is similar to the above-described filter except that the space inside the envelope is filled with a dielectric substance having a high dielectric constant, such as ceramics, and except for the respects described below. The dielectric substance forms a rectangular block 8 having opposed wall surfaces 8*a* and 8*b*. Two holes 9*c* and 10*c* extend in a parallel relation at a suitable interval through the block 8 between the wall surfaces 8*a* and 8*b* to form exciter lines. Three parallel holes 11*c*, 12*c*, 13*c* extend through the block 8 between the holes 9*c* and 10*c* in a substantially regularly spaced relation from one another. Every other holes 11*c* and 13*c* reach the side wall surface 8*a*, while the intervening hole 12*c* reaches the opposite side wall surface 8*b*. The inner walls of the holes 9*c*, 10*c*, 11*c*, 12*c*13*c* and the outer surface of the dielectric block 8 are coated with a metal by electroless plating, or they are coated with conductive paste or the like by baking, whereby electrode films are formed on them. A grounding electrode 14 is formed on the outer surface. Exciter lines 9 and 10 are formed in the holes 9*c* and 10*c*, respectively. Resonant lines 11, 12, 13 are formed in the holes 11*c*, 12*c*, 13*c*, respectively. The short-circuited ends 9*b* and 10*b* of the exciter lines 9 and 10 are connected to the grounding electrode 14 on the side wall surface 8*b*. Those portions of the grounding electrode 14 which are in the vicinities of the open ends 9*a* and 10*a* have been removed. Input and output terminals are brought out from the open ends 9*a* and 10*a*, respectively. The short-circuited ends 11*b*, 12*b*, 13*b* of the resonant lines 11, 12, 13 are connected to the grounding electrode 14 in the same way as the foregoing. The dielectric substance 8 occupies the space between the open ends 11*a*, 12*a*, 13*a* and the opposite grounding electrode 14.

Since the wavelengths of electromagnetic waves shorten in a dielectric substance having a high dielectric constant, the lines 9–13 can be made much shorter than the resonant wavelength. This filter is manufactured in much smaller size than the filter already described in connection with FIGS. 6 and 7, but its electrical actions including the creation of the bandpass characteristics are similar to those of the first-mentioned filter.

In the conventional filter described first, the inside of the envelope 1 is either permeated with air or kept in vacuum. Since electromagnetic waves propagate through the medium, i.e., air or vacuum, having a specific dielectric constant of 1, the medium does not allow the waves to shorten their wavelengths. For this reason, the lines 3–7 are long. Further, the envelope 1 and other components are large in size. Hence, the filter is large in size and heavy in weight.

In the conventional filter already described in connection with FIGS. 8 and 9, electromagnetic waves propagate through a dielectric substance having a high dielectric constant and so the wavelengths of the waves shorten. This allows the lines 9–13 to be manufactured in much shorter lengths. In this way, this filter has solved the problems with the first-mentioned conventional filter.

However, these two conventional filters still suffer from the same problem that the performance of the actually fabricated product deviates considerably from the designed characteristics.

This problem is further discussed below. Referring again to FIGS. 8 and 9, the lines 9–13 are coupled by electromagnetic field. The couplings planned at the stage of the designing of the filter are simply the couplings between neighboring lines, e.g., between the exciter line 9 and the resonant line 11 and between the resonant lines 11 and 12. In reality, however, when the filter functions actually, couplings occur between next lines but one, i.e., between the lines 9 and 12, between the lines 11 and 13, between the lines 12 and 10. If these couplings between next lines but one are also taken into account at the stage of design, the equation for design will become so complex that its analysis is almost impossible. Therefore, such couplings have not been included in the calculation. It is thought that the deviation of the performance of the actual product from the designed performance is due to the effects of such couplings. These undesired couplings are explained in the manner described below. Let us take the resonant line 11 shown in FIG. 9 by way of example. No electrode body exists between the open end 11*a* and the opposite grounding electrode 14, and therefore electromagnetic waves easily propagate. The lines 9 and 12 are coupled together primarily through this gap. For the same reason, the lines 11 and 13 are coupled together, and the lines 12 and 10 are coupled together Substantially the same situation applies to the first-mentioned conventional filter. That is, next lines but one are coupled together through the gaps between the open surfaces 5*a*, 6*a*, 7*a* of the resonant lines 5, 6, 7 and the opposite metal envelope 1. These couplings result in the deviation.

SUMMARY OF THE INVENTION

In view of the foregoing problems with the conventional interdigital line type filters, it is the object of the present invention to provide an interdigital line type filter that can be designed with high accuracy.

This object is achieved by an interdigital line type filter comprising: a dielectric block; a grounding electrode formed on the outer surface of the block; two parallel exciter lines extending through the block at an appropriate interval; and a plurality of parallel electrode bodies substantially regularly spaced from each other between the two exciter lines, the electrode bodies acting as resonant lines, short-circuited one end of each electrode body being connected to the grounding electrode, the other end being an open end that is not connected to the grounding electrode, the short-circuited ends and the open ends of any neighboring two of the electrode bodies being disposed on opposite sides, those portions of the block which are close to the open ends of the electrode bodies being removed so that the open ends are exposed.

Since the open ends of the electrode bodies are exposed as described above, no grounding electrode faces the open ends. Therefore, gap paths which couple next lines but one to each other do not exist. Hence, the deviation of the performance of the actually manufactured product from the performance of the designed performance is made smaller than conventional. Thus, the filter can be designed with improved accuracy.

DETAILED DESCRIPTION OF THE INVENTION

Figure 1:
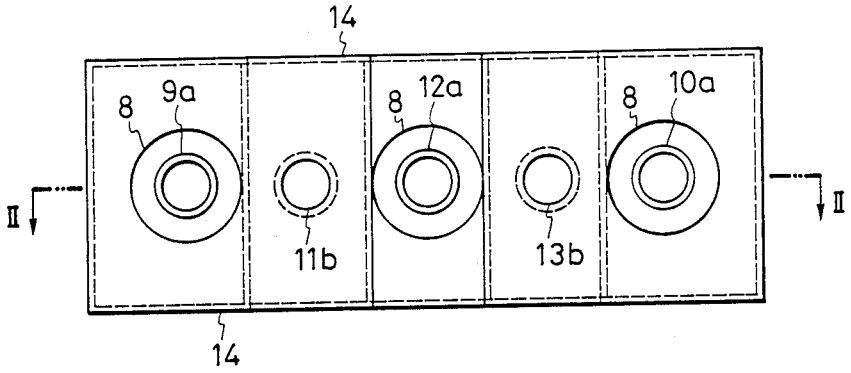
FIG. 1 is a front elevation of an interdigital line type dielectric filter according to the present invention.
Figure 2:
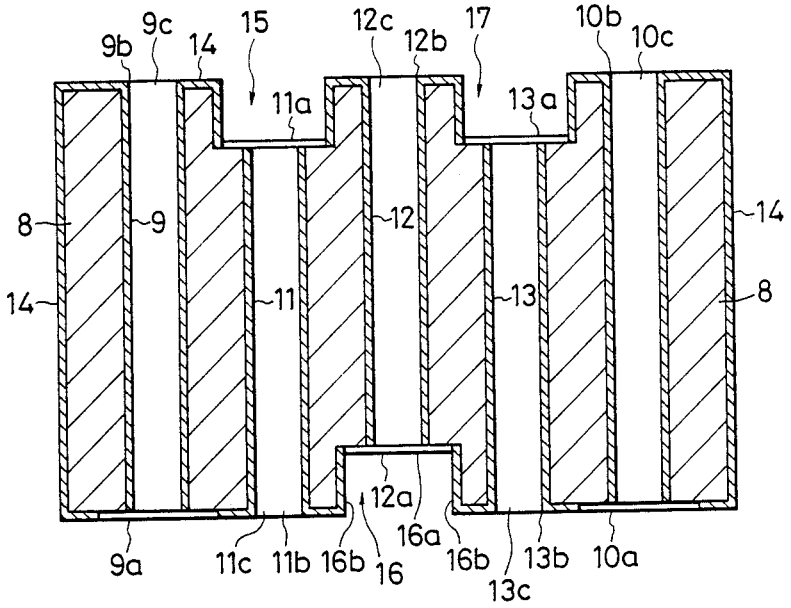
FIG. 2 is a cross-sectional view taken on line II—II of FIG. 1.

Referring to FIGS. 1 and 2, there is shown a filter according to the invention. It is to be noted that like components are denoted by like reference numerals throughout FIGS. 1, 2, 8, 9, and they will not be described hereinafter. This filter has dielectric block 8 in which electrode bodies acting as resonant lines 11, 12, 13 are formed. The block 8 is provided with grooves 15, 16, 17 in the vicinities of the open ends 11*a*, 12*a*, 13*a* of the resonant lines 11, 12, 13, the grooves 15–17 being broader than the diameter of the electrode bodies. That is, the block 8 is cut out at 15, 16, 17. Accordingly, the open ends 11*a*, 12*a*, 13*a* are exposed. Therefore, no grounding electrode is opposed to the open ends 11*a*, 12*a*, 13*a* of the resonant lines 11, 12, 13.

We describe the grooves in detail now by taking the groove 16 by way of example. A grounding electrode 14 is deposited on the side walls 16*b* and the bottom wall 16*a* of the groove 16, and the film of the grounding electrode 14 is cut coaxially around the open end 12*a* of the line 12 (FIG. 1). The open end 12*a* is kept in isolated relation from the grounding electrode 14. A so-called fringing capacitance is established between the open end 12*a* and the grounding electrode 14 that is substantially coaxial and coplanar with the end surface of the open end 12*a*. This fringing capacitance corresponds to the electrostatic capacitance formed between the open end of a line and the opposed grounding electrode in the conventional filter. This fringing capacitance is not continuous in nature, because the electric field is distributed discontinuously at the boundary between the inside of the dielectric block 8 and the outside of the open end 12*a*.

The operation of the filter is now discussed. First, the operation of the end surfaces of the resonant lines is described by taking the resonant line 12 by way of example. The open end 12*a* of the line 12 is exposed, and dielectric substance, opposed grounding electrode, or the like does not exist. The grounding electrode 14 is deposited on the side walls 16*b* and the bottom wall 16*a* of the groove 16 except for the cutouts around the open end 12*a*. Therefore, inside the space formed by the groove 16, there exists no electromagnetic wave-path through which the resonant line 11 and 13 neighboring the resonant line 12 are effectively coupled together. Consequently, in the actually fabricated product, the coupling through the space is much weaker than in the cases of the conventional filters. The bandpass characteristics are obtained from the resonant lines 11, 12, 13 in substantially the same way as the conventional filter already described in connection with FIGS. 8 and 9.

Figure 3:
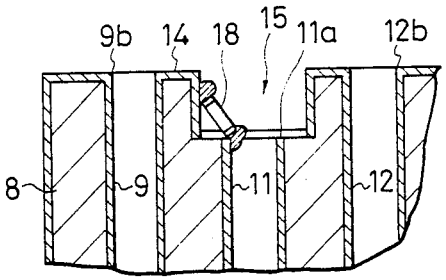
FIG. 3 is a cross-sectional view of main portions of another filter according to the invention.

Referring next to FIG. 3, there is shown another filter according to the invention. A chip capacitor 18 is connected by soldering between the open end 11*a* of the resonant line 11 and the grounding electrode 14. Similarly, other chip capacitors are connected between the open ends of the other lines and the grounding electrode 14.

The chip capacitor 18 adjusts the resonant frequency when the fringing capacitance at the open end 13*a* is insufficient, which is encountered with the case of the first-mentioned example of the invention. The connection of the chip capacitor 18 having an appropriate value of capacitance permits adjustment of the resonant frequency of the resonant line. Hence, the characteristics of the filter can be adjusted.

Figure 4:
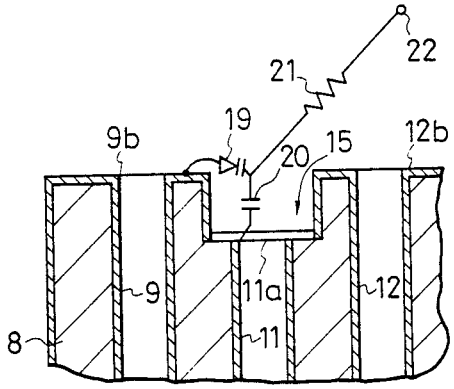
FIG. 4 is a cross sectional view of main portions of a further filter according to the invention.

Referring to FIG. 4, there is shown a further filter according to the invention. In this filter, the chip capacitor 18 used in the previous example for adjusting the resonant frequency has been replaced by a variable-capacitance diode 19. Also shown are a capacitor 20 for blocking direct current, a resistor 21 for blocking radio frequencies, and a terminal 22 at which a reverse bias voltage is applied to the diode 19. This bias voltage is higher than the potential at the grounding electrode 14.

In this example, the capacitance of the capacitor connected to the open end 11 can be varied by controlling the applied voltage. Therefore, the characteristics of the filter can be continuously adjusted over a given range.

Figure 5:
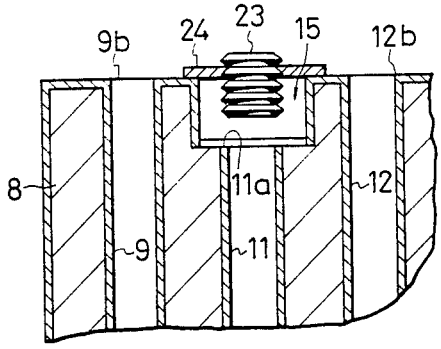
FIG. 5 is a cross-sectional view of main portions of a still other filter according to the invention.
Figure 6:
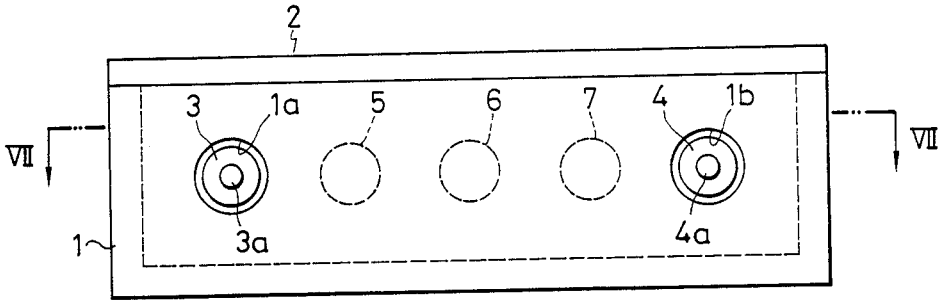
FIG. 6 PRIOR ART
FIG. 6 is a front elevation of a conventional filter.
Figure 7:
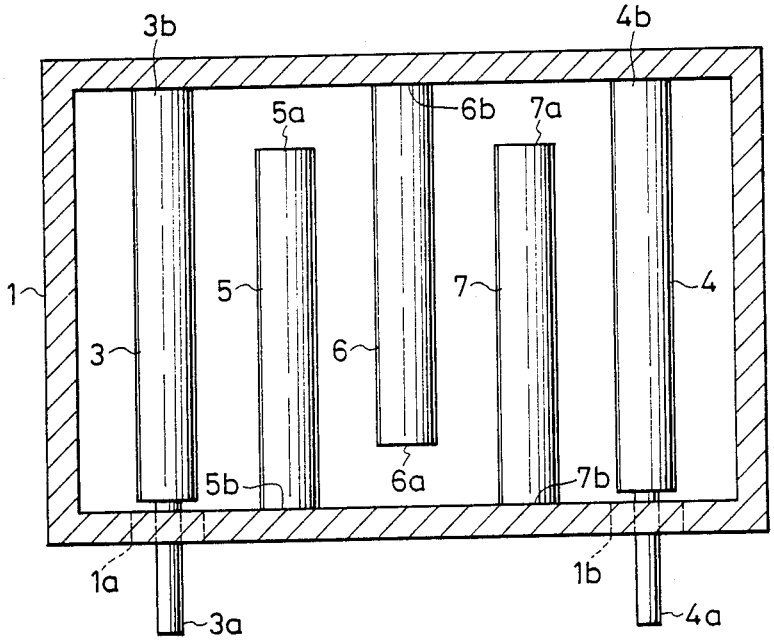
FIG. 7 PRIOR ART
FIG. 7 is a cross-sectional view taken on line VII—VII of FIG. 6.
Figure 8:
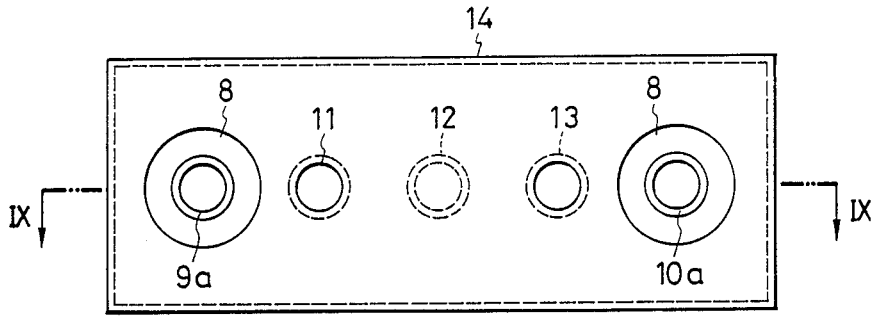
FIG. 8 PRIOR ART
FIG. 8 is a front elevation of another conventional filter.
Figure 9:
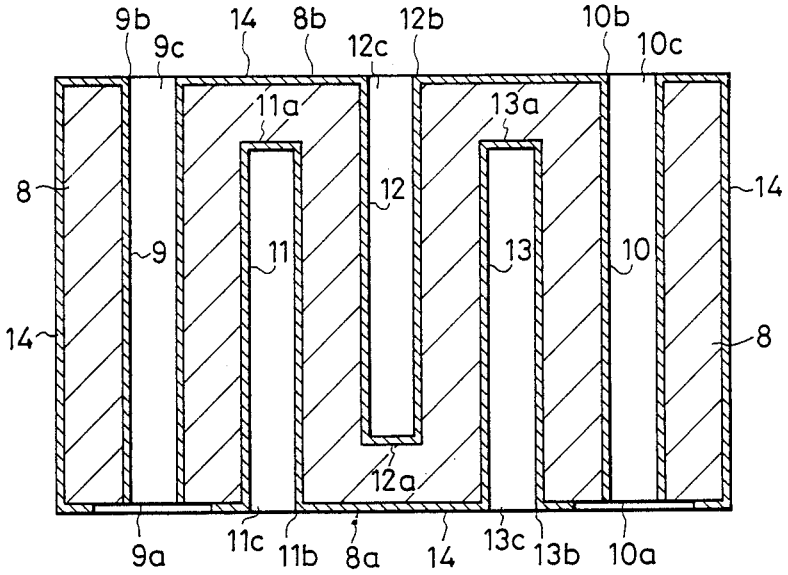
FIG. 9 PRIOR ART
FIG. 9 is a cross-sectional view taken on line IX—IX of FIG. 8.

Referring to FIG. 5, there is shown a yet other filter according to the invention. This filter uses a mechanical screw 23 for continuously adjusting the resonant frequency over a given range, instead of the variable-capacitance diode of the previous example. A conductive plate 24 has a tapped hole into which the screw 23 is screwed. The distance between the front end of the screw 23 and the open end 11*a* can be varied by controlling the amount by which the screw 23 is inserted. In this way, the capacitance connected to the open end 11*a* can be changed. This allows the characteristics of the filter to be continuously adjusted over a given range.

As described thus far in detail, in the novel filter according to the invention, those portions of the dielectric block which are in the vicinities of the open ends of electrodes forming resonant lines are removed. No grounding electrode is opposed to the open ends, which are therefore exposed. Thus, gap paths which couple next lines but one do not exist at the positions of the open ends. Consequently, the performance of the actually manufactured product deviates from the designed performance to a lesser extent than conventional. As a result, the filter can be designed with improved accuracy.

The aforementioned example in which means for adjusting the frequency are formed at the open ends of resonant lines yields the advantage that the resonant frequency of the resonant lines can be adjusted, thus allowing adjustment of the characteristics of the filter, in addition to the advantages common to all the examples.

What is claimed is:

1. An interdigital line type dielectric filter comprising:

a dielectric block extending in a lateral direction and a longitudinal direction;

a grounding electrode formed on the outer surface of the block;

two parallel holes extending through the block in a lateral direction at an appropriate longitudinal interval to form exciter lines;

a plurality of parallel electrode bodies between the two exciter lines extending through the block in the lateral direction substantially regularly spaced apart from one another in the longitudinal direction to form resonant lines, each electrode body being of a given cross-sectional width in the longitudinal direction and having one short-circuited end connected to the grounding electrode on one side of the dielectric block and the other end being an open end that is not connected to the grounding electrode on an opposite side of the dielectric block, the short-circuited end and the open end of any one of the electrode bodies being disposed on alternate sides of the dielectric block from those of an adjacent electrode body; and cutouts formed in the dielectric block in the vicinity of each respective one of the open ends of the electrode bodies, said cutouts being recessed laterally inward from the sides of the dielectric block, each cutout having lateral walls defining the recess which are lined by the grounding electrode extending inwardly in the direction to lateral a bottom part which is coaxial and coplanar with the open end of the electrode body and has a width in the longitudinal direction wider than the given width of the electrode body and along which the grounding electrode does not extend, whereby the open ends of the electrode bodies are exposed, no grounding electrode is facing opposite the open ends, each open end is isolated from the grounding electrode along the lateral walls of the cutout recess by the dielectric block which is exposed due to the bottom part of the cutout recess having the width wider than the width of the electrode body, and a fringing capacitance is established between the open end of the electrode body and the grounding electrode along the lateral walls of the cutout recess.

2. An interdigital line type dielectric filter as set forth in claim 1, wherein a chip capacitor is connected between the grounding electrode and the open end of each resonant line.

3. An interdigital line type dielectric filter as set forth in claim 1, wherein a combination of a variable-capacitance diode and a capacitor is connected between the grounding electrode and the open end of each resonant line.

4. An interdigital line type dielectric filter as set forth in claim 1, wherein an adjustable screw is inserted in each of said cutouts.

* * * * *

UNITED STATES PATENT AND TRADEMARK OFFICE

CERTIFICATE OF CORRECTION

PATENT NO. : 4,757,284

DATED : July 12, 1988

INVENTOR(S) : Moriaki Ueno

It is certified that error appears in the above-identified patent and that said Letters Patent is hereby corrected as shown below:

Claim 1, Col. 6, line 19, delete "in the direction to lateral", and insert --in the lateral direction to--.

Signed and Sealed this

Thirteenth Day of December, 1988

*Attest:*

DONALD J. QUIGG

*Attesting Officer*

*Commissioner of Patents and Trademarks*